US005129431A

United States Patent [19]

Stacher

[11] Patent Number: 5,129,431

[45] Date of Patent: Jul. 14, 1992

[54] GIVER FOR A GRIPPER LOOM

[75] Inventor: Angelo Stacher, Arbon, Switzerland

[73] Assignee: Sulzer Brothers Limited, Winterthur, Switzerland

[21] Appl. No.: 646,671

[22] Filed: Jan. 28, 1991

[30] Foreign Application Priority Data

Feb. 5, 1990 [CH] Switzerland ..... 00353/90

[51] Int. Cl.[5] ..... D03D 47/20

[52] U.S. Cl. ..... 139/448; 139/1 C

[58] Field of Search ..... 139/448, 1 C, 196.2

[56] References Cited

U.S. PATENT DOCUMENTS 4,757,844 7/1988 Pezzoli ..... 139/448

FOREIGN PATENT DOCUMENTS 2752667 5/1979 Fed. Rep. of Germany ..... 139/448

2113237 6/1972 France .

2222467 10/1974 France .

2447988 8/1980 France .

2635538 2/1990 France .

1245336 10/1986 Japan ..... 139/448

2058853 4/1981 United Kingdom .

2083844 3/1982 United Kingdom .

*Primary Examiner*—Andrew M. Falik

[57] ABSTRACT

A giver for a gripper loom having horizontal weft feeding has a head open at the top. A wide slideway ensures gentle treatment of the warp yarns and the low center of gravity reduces the tendency of the head to disengage from the slideway when the weft yarn is being drawn into the shed. A yarn clamp which keeps the weft yarn horizontal has a fin-like member which deflects the weft yarn downwards before entry into the clamp.

19 Claims, 2 Drawing Sheets

GIVER FOR A GRIPPER LOOM

Figure 1:
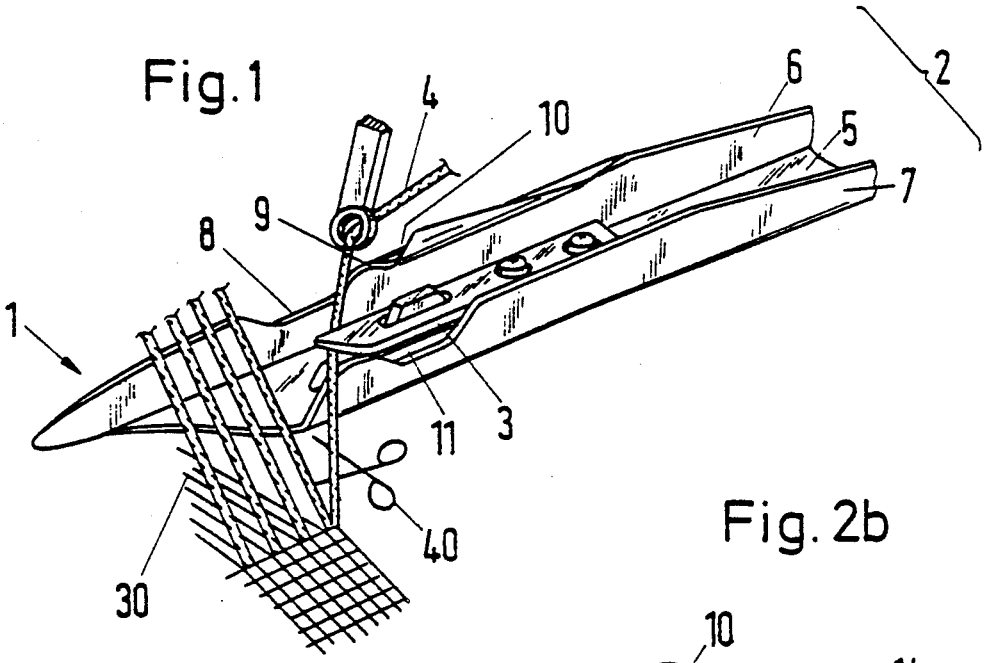

This invention relates to a giver for a gripper loom.

As is known, gripper looms have been constructed so as to transfer a weft yarn across a shed of warp yarns by using flexible picking tapes. For example, such looms employ a structure known as a "giver" which is guided to the center of a shed in order to transfer a weft yarn to a "taker" and returned to a point outside the shed to receive a fresh weft yarn. Generally, the giver is constructed with a head which is secured to a flexible picking tape and which has an appropriate yarn guide and a yarn clamp in order to transfer a weft yarn at the center of a shed for transfer to a taker. Since the giver is required to grip a fed yarn reliably and not to lose the yarn while, at the same time, supplying the yarn accurately to a taker, the giver must be of fairly rugged and, therefore, heavy construction. In a giver construction which has been used at present and which is known from Swiss Patent 592,761, the gripper slides on runners disposed at the bottom ends of two side walls of the giver. These runners, however, stress the warp yarn considerably and to an extent which is possible to damage the warp yarns. In addition, the giver construction has a bridge-like top part interconnecting the side walls of the head so that the center of gravity of the construction is very high. Since the flexible tape moving the head through the shed moves directly over the warp yarns, the high center of gravity becomes a cause of a torque which causes a movement which is difficult to control and which has a tendency to cause the giver head to disengage.

The giver according to Swiss Patent 592,761 has other disadvantages. The tip of the griped weft yarn emerges from the bottom of the giver and grazes the warp yarns as the tip moves over warp yarns. The weft yarn tip may also engage between the runners and the warp yarns, with the result of damage both to the warp yarns and to the weft yarn end. Another disadvantage concerns the cleaning of the yarn clamp. When the giver is in a drawn-back position, the yarn clamp is opened by pressure on a laterally projecting piece and fibers which have stuck to the clamp are removed by suction. The pressing of the projecting member produces a tilting moment which must be countered by special steps. Another disadvantage is a complicated arrangement of a suction nozzle below the giver guideway.

Additional examples of givers which have been employed in gripper looms have been described in U.K. Patent Applications 2,083,844 and 2,058,583 as well as French Patents 2,635,538 and 2,113,237. However, such constructions have been relatively complex. More simplified giver constructions are described in French Patents 2,447,988 and 2,222,467; however, these givers have a relatively high center of gravity.

Accordingly, it is an object of the invention to provide a giver of relatively simple construction which can be guided into and out of a shed in a reliable manner.

It is another object of the invention to prevent the tip of a gripped weft yarn in a giver for a gripper loom from engaging the warp yarns of a shed during insertion into the shed.

It is another object of the invention to reduce damage to warp yarns during insertion of weft yarn in a gripper loom.

It is another object of the invention to simplify the cleaning of a giver for a gripper loom.

Briefly, the invention provides a giver for a gripper loom which has a head for securing to a flexible picking tape and which has an open top and a partly convex and partly flat bottom to define a slide way. In addition, a top guide for a weft yarn is disposed on one side of the head and a yarn clamp is disposed on an opposite side of the head for clamping a weft yarn therein. This clamp is further disposed relative to the yarn guide in order to hold a weft yarn therebetween within the head and at an angle to a cloth plane of less than 45 degrees. The yarn guide is so devised that the yarn is deflected and supplied at the correct place to the yarn clamp.

One of the advantages of the giver is that the center of gravity of the head is low. Thus, the giver movement through a shed tends less to disengage the giver. Further, the slide way is relatively wide so that the warp yarns over which the giver travels may be treated gently. Also, the fact that the giver head is open at the top facilitates visual checks and enhances accessibility, particularly to the yarn clamp. This is especially advantageous for cleaning and repair work.

The giver head is a unitary main body which can be made economically from sheet metal while the clamp is within the main body. The yarn guide which is disposed at the top edge of the giver wall which is near the reed can be produced simply, for example, by bending the sheet metal of which the main body is made. The yarn guide can be devised by means of a recess contrived from the giver wall.

The main body of the giver head is sheath-like so that the taker can enter the giver interior and take over the weft yarn presented there. The yarn clamp is so disposed in the interior that clearance is left for the taker.

The yarn clamp is disposed immediately adjacent the giver wall on the cloth side and is provided with a rigid plate-like fin (lamella) which deflects the weft yarn coming from the yarn guide down towards the base of the giver head before the yarn is returned upwards to the clamping station. This deflecting fin of the clamp provides yarn guidance in the giver head in a direction extending diagonally through the interior which is free for the taker.

Advantageously, the giver base can be formed with an aperture below the deflecting fin, for relatively thick yarn can then be guided around the fin without hindrance from the giver base.

The yarn clamp, which is basically known except for the fin (German Patent 2,947,399) acts to keep the weft yarn horizontal. The yarn end therefore extends out of the giver through a trough in the side wall and so does not contact the warp yarns, so that there is no possibility of the weft yarn and warp yarns damaging one another. The clamp and the associated trough in the side wall also facilitate the removal of clinging fibers laterally by means of a suction nozzle, something which is advantageous as compared with cleaning with a suction nozzle below the giver guideway.

The giver is particularly useful in a tape gripper loom in which the picking tapes of the givers are reciprocated by means of oscillating tape wheels. The giver is also of use for looms in which the weft yarn is fed horizontally. Unlike the vertical weft feeding used in other gripper looms, horizontal weft feeding requires the use of a giver with which there is a risk of yarns being torn. There is no such risk with the giver according to the invention.

Figure 2B:
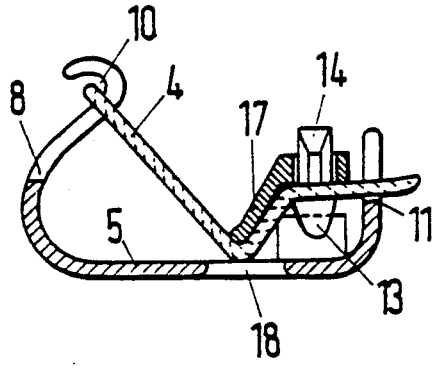
Figure 2A:
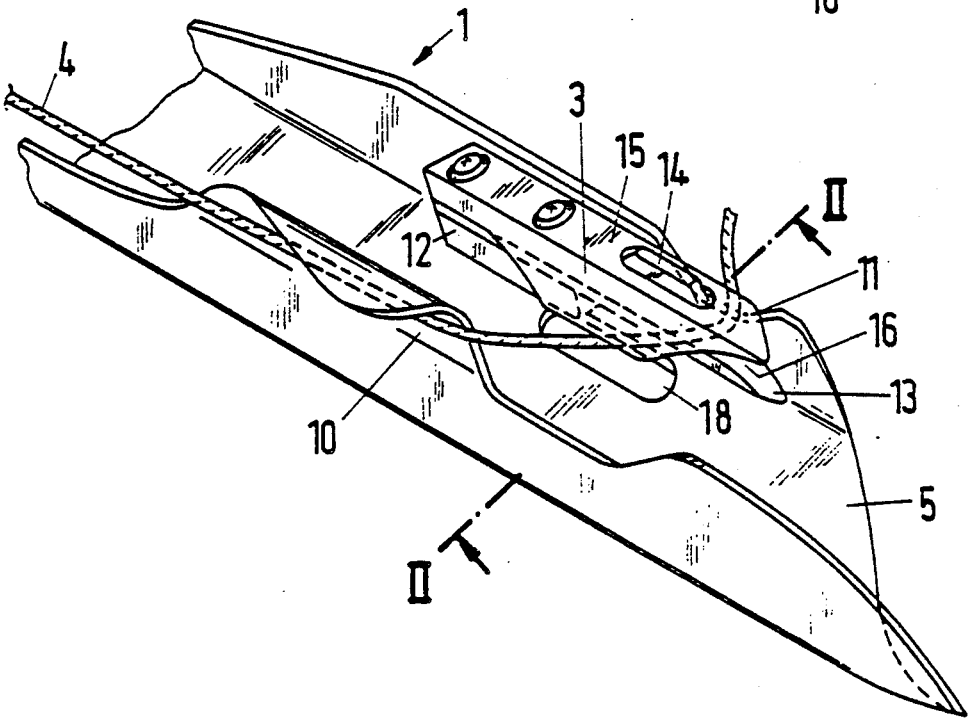

These and other objects and advantages of the invention will become more apparent from the following detailed description taken in conjunction in accordance with the accompanying drawings wherein:

FIG. 1 illustrates a perspective view of a giver constructed in accordance with the invention at the time of clamping a weft yarn in a gripper loom;

FIG. 2*a* illustrates a perspective view of the giver of FIG. 1 taken from the reed side of a gripper loom;

FIG. 2*b* illustrates a cross-sectional view taken on line II—II of FIG. 2*a;*

Figure 3B:
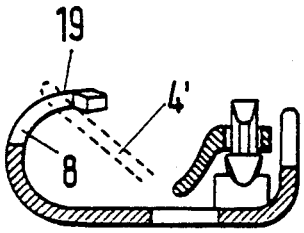
Figure 3A:
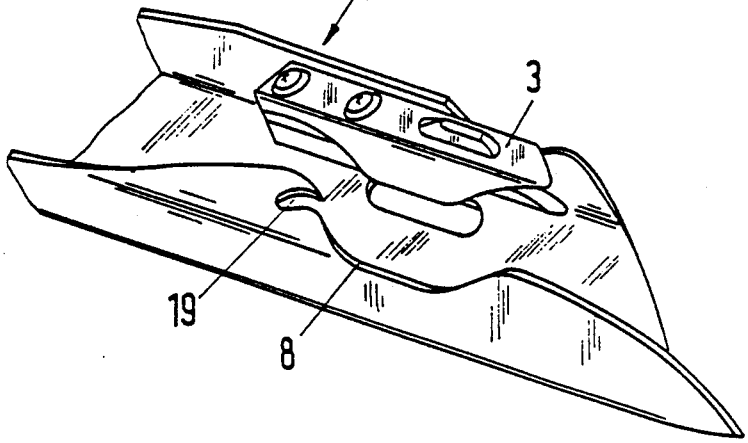

FIG. 3*a* illustrates a view similar to FIG. 2*a* of a modified giver in accordance with the invention;

FIG. 3*b* illustrates a cross sectional view of the giver of FIG. 3*a;*

Figure 4B:
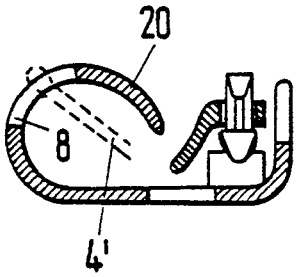
Figure 4A:
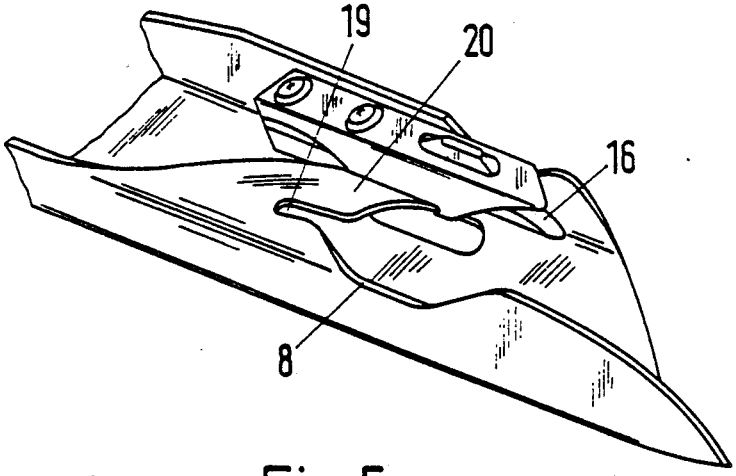

FIG. 4*a* illustrates a view of a further modified giver in accordance with the invention;

FIG. 4*b* illustrates a cross sectional view of the giver of FIG. 4*a;*

Figure 5B:
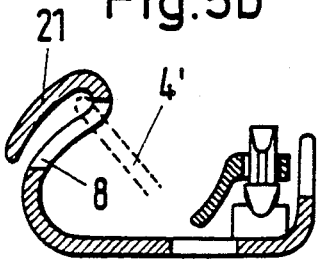
Figure 5A:
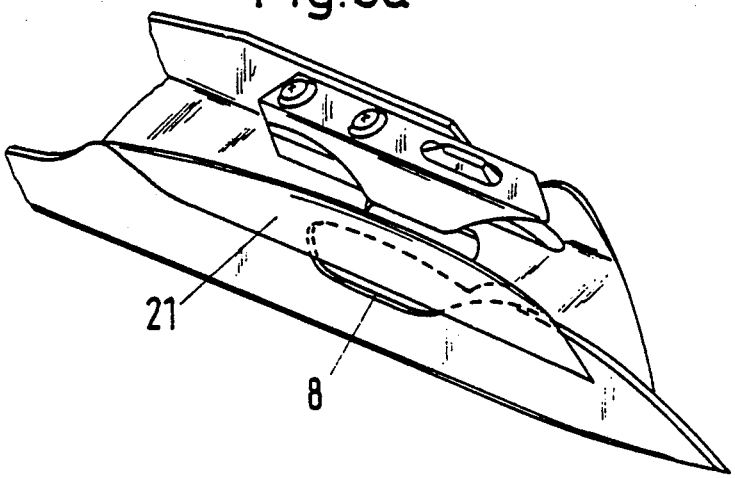

FIG. 5*a* illustrates a perspective view of a further modified giver in accordance with the invention; and FIG. 5*b* illustrates a cross sectional view of the giver of FIG. 5*a*.

Referring to FIG. 1, the giver 1 is constructed for use in a gripper loom and would normally be secured to a flexible picking tape (not shown) which moves in a shed 30 of warp yarns within the loom.

The giver 1 has a main body 2 which is of channel-shape with a base 5, in the form of a slide way, and two side walls 6, 7 which define an open top therebetween. As indicated, the contour of the top edge of the gripper wall 6 on the reed side is shaped towards the tip of the giver in order to adapt to the supply of infed weft yarn 4. After forming a rising curve immediately after the giver tip, the top edge of the wall 6 descends into a trough 8 and then merges into a rising incline 9 which is curved towards the center of the giver.

Referring to FIG. 2*a*, the giver 1 also has a top guide 10 for the weft yarn 4 on the wall 6. As indicated, the guide 10 is integrally formed from the wall 6 and is curved over longitudinally of the length of the giver 1 so as to guide the weft yarn 4 thereunder.

In addition, a yarn clamp 3 is disposed on the opposite wall 7 of the giver head 1 for clamping the weft yarn 4 therein. As indicated, the yarn clamp 3 is disposed on the cloth side within the interior of the main body 2 and is disposed relative to the yarn guide 10 in order to hold weft yarn 4 therebetween within the head 1 and at an angle to a cloth plane of less than 45 degrees. In FIG. 1, the weft yarn 4 which has been taken from a stationary yarn supply (not shown) is just entering the clamp 3. Later, when the giver 1 is further into the shed, and the clamp 3 is holding the yarn 4 reliably, cutting means 40, for example, in the form of shears are operated. The free cut end, now the tip of the weft yarn 4, then extends laterally out of the head 1 through a trough 11 in the side wall 7 of the giver.

As indicated in FIG. 1, the incline 9 of the wall 6 guides the weft yarn 4 into the clamp 3. When the head 1 enters further into the shed, the yarn 4 is forced into the groove-like yarn guide 10 as indicated in FIG. 2*a*.

Referring to FIGS. 2*a* and 2*b*, the yarn clamp 3 has a plinth which is, for example, welded to the main body 2 as well as a resilient tongue 13 and a rigid clamp jaw 15 which are secured by screws to the plinth 12. At the front end, the tongue 13 and the jaw 15 cooperate to bound a funnel-shaped tongs 16. In addition, the jaw 15 is formed with an aperture for a cam 14 which is secured to the tongue 13 and which is effective to open the clamping gap when the giver is in a drawn-back position so that clinging fibers can be extracted by means of a suction nozzle, at this time, disposed near the side trough 11. An aperture 18 is also provided in the base 5 of the giver near the yarn clamp 3 which is intended for thick yarn.

Referring to FIG. 2*b*, which is taken through the two lateral troughs 8, 11 in the respective wall 6, 7, the base 5 has a slideway which is flat in the center except for the aperture 18 while being convex in the two edge zones. If the aperture 18 has a rounded bottom edge, the slideway cannot damage the warp yarns during travel of the giver through the shed 30. As illustrated, the weft yarn 4 extends from the yarn guide 10 outwardly to the aperture 18 diagonally through the free interior of the giver head. This is facilitated by a yarn-deflecting fin 17 which extends from the jaw 15 of the yarn clamp. As illustrated, the tip of the tongue 13 is downwardly curved.

Referring to FIGS. 3*a* and 3*b*, wherein like reference characters indicate like parts as above, the giver 1 may be constructed so that the wall closest to the reed has an outwardly bent part to the rear of the trough 8 in order to bound a recess 19. As illustrated, the bent part is bent towards the center of the giver while the recess 19 is effective as a yarn guide.

Referring to the variant shown in FIGS. 4*a* and 4*b*, the yarn guide 19 is in the form of a recess but the wall part which extends towards the gripper center is, in this embodiment, prolonged to provide a partial roofing-over 20 of the gap between the yarn guide 19 and the clamp 3. The front edge of the roofing-over 20 helps to guide the infed weft yarn correctly into the tongs 16.

In the variant shown in FIGS. 5*a* and 5*b*, the yarn guide is groove-like as in the first embodiment but the outwardly bent wall part 21 is prolonged and is effective to displace the top warp sheet upwards and thus protect the warp sheet from being damaged by projecting parts of the giver head. A similar roofing-over on the reed side is present in the giver described in Swiss Patent 592 761. The omission of such roofing-over in the giver heads hereinbefore described has the advantage that the giver requires less space and thus helps to reduce the cross-section of the front shed.

The invention thus provides a giver for a gripper loom which is a relatively simple construction and particularly one which has a low center of gravity for travelling through a shed of warp yarns. Further, the invention provides a giver which is able to hold the end of a weft yarn in a manner so that a leading edge of the yarn does not run against the warp yarns of a shed during picking.

What is claimed is:

1. A giver for a gripper loom, said giver comprising
   a head for securement to a flexible picking tape, said head having an open top and a partly convex and partly flat bottom defining a slideway;
   a top guide for a weft yarn on one side of said head; and
   a yarn clamp on an opposite side of said head for clamping a weft yarn therein, said clamp being disposed relative to said guide to hold a weft yarn therebetween within said head and at an angle to a cloth plane of less than 45°.

2. A giver as set forth in claim 1 wherein said head has a sheet metal body of channel-shape with said clamp secured within said body.

3. A giver as set forth in claim 2 wherein said yarn guide is integrally formed with said body and defines a groove for guiding a weft yarn along one side of said body.

4. A giver as set forth in claim 1 wherein said head has a wall on one side and said guide has a recess in said wall for receiving a weft yarn.

5. A giver as set forth in claim 1 which further comprises a roof-like portion extending from said yarn guide towards said clamp to cover over a weft yarn disposed between said guide and said clamp.

6. A giver as set forth in claim 1 wherein said head has a wall on a side near a reed and a roof-like portion extending outwardly from said wall.

7. A giver as set forth in claim 1 which further comprises a yarn-deflecting fin depending from said clamp to hold down a weft yarn extending between said guide and said clamp.

8. A giver a set forth in claim 7 wherein said bottom has an aperture below said fin.

9. A giver as set forth in claim 1 wherein said yarn guide and said clamp are horizontally spaced apart to hold a weft yarn therebetween in a substantially horizontal disposition.

10. A giver as set forth in claim 1 wherein said head has a lateral wall adjacent said clamp and a recess in said wall aligned with said clamp to permit suctioning out of fibers from said clamp through said recess.

11. A giver for a gripper loom, said giver comprising a body of channel-shape having an open top, a bottom defining a slideway, and a yarn guide on one side; and a yarn clamp secured in said body for clamping a weft yarn therein, said clamp being disposed relative to said yarn guide to hold a yarn therebetween within said body and at an acute angle to said yarn guide.

12. A giver as set forth in claim 11 wherein said yarn guide is integrally formed with said body and defines a groove for guiding a weft yarn along one side of said body.

13. A giver as set forth in claim 11 wherein said body has an upstanding wall on said one side and said yarn guide extends therefrom.

14. A giver as set forth in claim 13 wherein said yarn guide extends inwardly of said wall and has a recess for receiving a weft yarn.

15. A giver as set forth in claim 14 which further comprises a roof-like portion extending from said yarn guide towards said clamp to cover a weft yarn.

16. A giver as set forth in claim 13 which further comprises a roof-like portion extending forwardly of said yarn guide to guide said body under a top shed of warp yarns.

17. A giver as set forth in claim 11 which further comprises a yarn-deflecting fin depending from said clamp to hold down a weft yarn extending between said guide and said clamp.

18. A giver as set forth in claim 17 wherein said bottom has an aperture below said fin.

19. A giver as set forth in claim 11 wherein said body has a lateral wall adjacent said clamp and a recess in said wall aligned with said clamp to permit suctioning out of fibers from said clamp through said recess.

* * * * *